US011131078B2

(12) United States Patent
Gröhn et al.

(10) Patent No.: US 11,131,078 B2
(45) Date of Patent: Sep. 28, 2021

(54) JIB ASSEMBLY

(71) Applicant: MANTSINEN GROUP LTD OY, Ylämylly (FI)

(72) Inventors: Pekka Gröhn, Ylämylly (FI); Pentti Laakkonen, Ylämylly (FI); Simo Huovinen, Ylämylly (FI)

(73) Assignee: MANTSINEN GROUP LTD OY, Ylamylly (FI)

( * ) Notice: Subject to any disclaimer, the term of this patent is extended or adjusted under 35 U.S.C. 154(b) by 0 days.

(21) Appl. No.: 16/487,879

(22) PCT Filed: Jan. 11, 2018

(86) PCT No.: PCT/FI2018/050019
§ 371 (c)(1),
(2) Date: Aug. 22, 2019

(87) PCT Pub. No.: WO2018/138409
PCT Pub. Date: Aug. 2, 2018

(65) Prior Publication Data

US 2020/0291607 A1 Sep. 17, 2020

(30) Foreign Application Priority Data

Jan. 25, 2017 (FI) ..... 20175062

(51) Int. Cl.
*E02F 9/14* (2006.01)
*B66C 23/00* (2006.01)
(Continued)

(52) U.S. Cl.
CPC ..... *E02F 9/14* (2013.01); *B66C 23/54* (2013.01); *B66C 23/68* (2013.01); *B66C 23/821* (2013.01); *E02F 3/425* (2013.01)

(58) Field of Classification Search
CPC .. E02F 3/425; E02F 9/14; B66C 23/54; B66C 23/64; B66C 23/68; B66C 23/82; B66C 23/821; B66C 23/823
See application file for complete search history.

(56) References Cited

U.S. PATENT DOCUMENTS 2,437,466 A 3/1948 Hail
2,890,805 A * 6/1959 Pilch ..... E02F 3/425 414/694

(Continued)

FOREIGN PATENT DOCUMENTS

GB 1432124 A 4/1976
SE 221700 C1 7/1968

OTHER PUBLICATIONS

Written Opinion of the International Searching Authority issued by the European Patent Office acting as the International Searching Authority in relation to International Application No. PCT/FI2018/050019 dated Apr. 10, 2018 (5 pages).

(Continued)

*Primary Examiner* — Sang K Kim
*Assistant Examiner* — Nathaniel L Adams
(74) *Attorney, Agent, or Firm* — Robert P. Michal, Esq.; Carter, DeLuca & Farrell LLP

(57) ABSTRACT

A jib assembly includes a support; a jib attached pivotally to the support for pivotal movement of the jib in relation to the support about a horizontal axis; a first linear hydraulic actuator attached to the support for regulating pivotal movement of the jib and for maintaining the jib in a specific position relative to the support; a lever arm attached unrotatably to the jib; and a draw member attached to the lever arm and to the jib; wherein the first linear hydraulic actuator is attached to the lever arm, and the lever arm is arranged to extend in the direction above the jib.

9 Claims, 1 Drawing Sheet

(51) Int. Cl.

| | |
|---|---|
| ***B66C 23/68*** | (2006.01) |
| ***B66C 23/82*** | (2006.01) |
| ***E02F 3/42*** | (2006.01) |

(56) References Cited

U.S. PATENT DOCUMENTS

| | | | | | |
|---|---|---|---|---|---|
| 2,927,706 | A * | 3/1960 | Mork | E02F 3/303 | 414/694 |
| 2,972,199 | A * | 2/1961 | Learmont | E02F 3/48 | 37/395 |
| 3,097,749 | A | 7/1963 | Hahn | | |
| 3,374,901 | A * | 3/1968 | Ferwerda | B66C 23/36 | 212/175 |
| 3,717,269 | A | 2/1973 | Schaeff | | |
| 4,078,666 | A * | 3/1978 | Kather | B66C 23/52 | 212/307 |
| 6,079,577 | A | 6/2000 | Heikkilä | | |
| 2016/0244943 | A1* | 8/2016 | Currigan | E02F 3/964 | |

OTHER PUBLICATIONS

International Search Report issued by the European Patent Office acting as the International Searching Authority in relation to International Application No. PCT/FI2018/050019 dated Apr. 10, 2018 (3 pages).

International Preliminary Report on Patentability issued by the International Bureau of WIPO in relation to International Application No. PCT/FI2018/050019 dated Jul. 30, 2019 (6 pages).

Communication of Acceptance issued by the Finnish Patent and Registration Office in relation to Finnish Application No. 20175062 dated Aug. 11, 2017 (4 pages).

Search Report issued by the Finnish Patent and Registration Office in relation to Finnish Application No. 20175062 dated Aug. 11, 2017 (1 page).

* cited by examiner

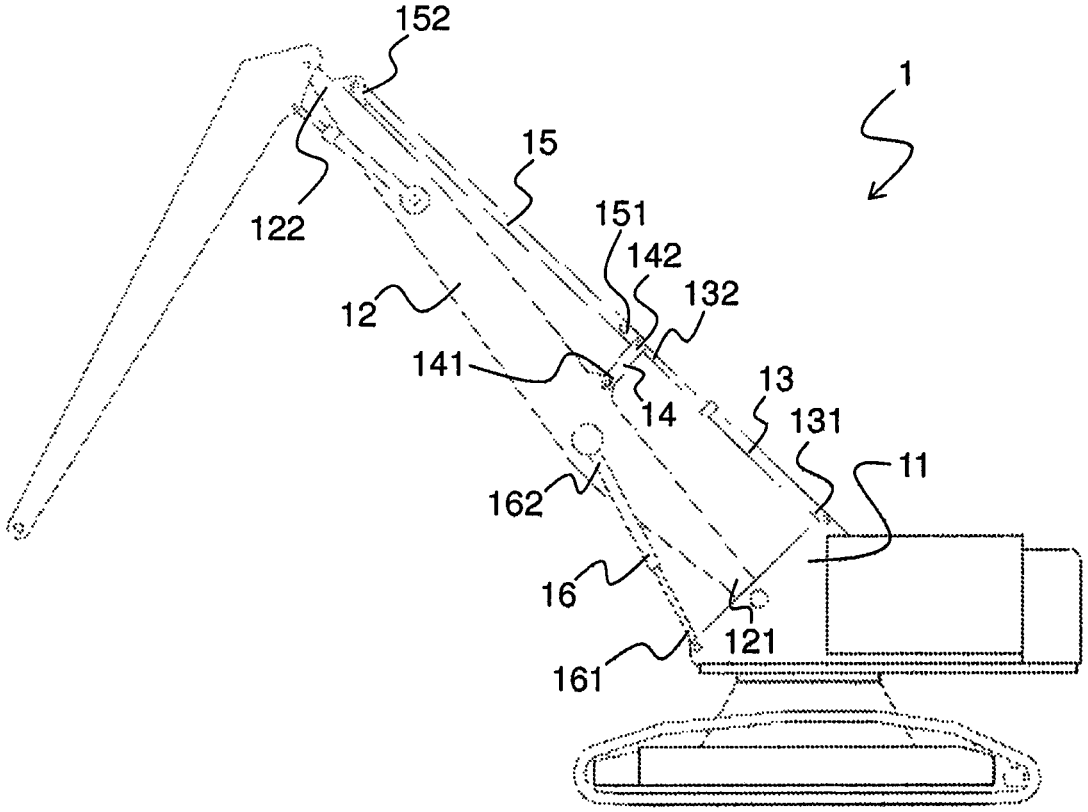
152
1
15
122
151
142
132
12
141
14
13
131
11
162
16
121
161

JIB ASSEMBLY

CROSS-REFERENCE TO RELATED APPLICATIONS

This application is a national phase entry under 35 U.S.C. 371 of PCT International Application No. PCT/FI2018/050019 filed Jan. 11, 2018, which claims priority to Finnish Patent Application No. 20175062, filed Jan. 25, 2017, the disclosure of each of these applications is expressly incorporated herein by reference in their entirety.

FIELD OF THE DISCLOSURE

The present disclosure relates to a jib assembly, for example for an excavator or material handler.

BACKGROUND OF THE DISCLOSURE

Document GB 1432124 A discloses jib assemblies, where potential energy is transferred between a jib, pivoted at on a support, and an accumulator through fluid passing via a duct between a chamber in a hydraulic jack and the accumulator as the jib is luffed by conventional means. The jack may be replaced by a jack having a rotary piston.

A problem with the known assembly is that because the pulling and pushing force of two hydraulic cylinders, i.e. the hydraulic jacks, is applied to a small area at the base of the jib, it causes a great bending moment and a concentration of stress to the jib, which results in fatigue of the structure over time. To overcome this, the jib structure must be made rugged enough, i.e. heavy, which reduces the lifting capacity and energy economy.

Another problem relates to attaching the hydraulic cylinder directly to the support and to the jib, limiting the geometry of the structure. This results in generation of a certain lifting moment at each lifting angle of the jib, which may not be practical for the need. The geometry and the required raise of the jib forces to use a hydraulic cylinder of a certain length. Because the lifting moment cannot be directed practically, the piston travel of the hydraulic cylinder must be unnecessary long, which generates lifting moment to areas where it is not needed. In high angles of the jib, extra lifting moment is a hindrance because it requires pressing the jib downwards to get the jib down, when there is no load. The stroke, i.e. the volume, of the hydraulic cylinder on the other hand is directly proportional to the volume of an accumulator when a certain force and pressure level is desired to be maintained. The volume of the accumulator is expensive for example because of the regulation relating to pressure vessels.

The aforementioned problems are especially present in excavators requiring wide movements and long jibs.

BRIEF DESCRIPTION OF THE DISCLOSURE

An object of the present disclosure is to provide a jib assembly to solve the above problems.

The object of the disclosure is achieved by a jib assembly which is characterized by what is stated in the independent claims. The preferred embodiments of the disclosure are disclosed in the dependent claims.

The disclosure is based on the idea of providing a jib assembly comprising a jib, a linear hydraulic actuator for regulating pivotal movement of the jib and for maintaining the jib in a specific position, a lever arm attached to the jib and a draw member attached to the lever arm and to the jib, wherein the linear hydraulic actuator is attached to the lever arm and the lever arm is arranged to extend in the direction above the jib.

An advantage of jib arrangement of the disclosure is that when the jib is positioned essentially vertically, the required lifting moment is reduced significantly. In this situation, the current solution provides small lifting moment and a very small change in the length of the hydraulic cylinder in relation to the angular change. This results in ability to size the hydraulic cylinder and the accumulator practically.

Another advantage of the jib arrangement of the disclosure is that because a part of the lifting moment is transmitted by the draw member to a further point of the jib, for example to the end of the jib, it provides the jib with a smaller bending moment. Because of the geometry, only a small component of force is brought to stressed area of the jib by the lever arm. Additionally, this component of force resists the normal fatiguing bending in the positions of the jib causing most stress.

BRIEF DESCRIPTION OF THE DRAWINGS

In the following the disclosure will be described in greater detail by means of preferred embodiments with reference to the accompanying drawing, in which FIG. 1 is a schematic view of a jib assembly according to an embodiment of the disclosure.

DETAILED DESCRIPTION OF THE DISCLOSURE

The disclosure relates to a jib assembly 1. The jib assembly 1 comprises a support 11. The support 11 is for example formed by a frame of an excavator.

The jib assembly 1 comprises a jib 12. For example, the jib is arranged to support the arm of the excavator connected to the bucket (not shown in the FIGURE). The jib 12 is attached pivotally to the support 11 for pivotal movement of the jib 12 in relation to the support 11 about a horizontal axis. For example, the jib 12 comprises a first end 121 and a second end 122, and the first end 121 of the jib 12 is attached to the support 11.

The jib assembly 1 comprises a lever arm 14. The lever arm 14 is attached essentially unrotatably to the jib 12. For example, the lever arm comprises a first end 141 and a second end 142, and the first end 141 of the lever arm 14 is attached to the jib 12. The lever arm 14 is arranged to extend in the direction above the jib 12. For example, the lever arm 14 is bolted or welded to the jib 12. Alternatively, the lever arm 14 is attached to the jib by pins (not shown in the FIGURE) According to an embodiment, the lever arm 14 is integral with the jib 12.

The jib assembly 1 comprises a first linear hydraulic actuator 13 for regulating pivotal movement of the jib 12 and for maintaining the jib 12 in a specific position relative to the support 11. For example, the first linear hydraulic actuator 13 comprises a hydraulic cylinder. According to an embodiment, the jib assembly 1 comprises a plurality of the first linear hydraulic actuators 13. The first linear hydraulic actuator 13 is attached to the support 11. For example, the first linear hydraulic actuator 13 comprises a first end 131 and a second end 132, and the first end 131 of the first linear hydraulic actuator 13 is attached to the support 11. The first linear hydraulic actuator 13 is supported by the lever arm 14. For example, the second end 132 of the first linear hydraulic actuator 13 is connected to the second 142 end of the lever arm 14.

The jib assembly 1 comprises a draw member 15. The draw member 15 is attached essentially unrotatably to the lever arm 14 and to the jib 12. The draw member 15 is attached to the jib 12 at a position away from the support 11 in relation to the lever arm 14. For example, the draw member 15 comprises a first end 151 and a second end 152, and the first end 151 of the draw member 15 is attached essentially unrotatably to the second end 142 of the lever arm 14 and the second end 152 of the draw member 15 is attached essentially unrotatably to the second end 122 of the jib 12. According to an embodiment, the draw member 15 is a drawbar. According to an alternative embodiment, the draw member 15 is a cable. The first linear hydraulic actuator 13 is connected to the draw member 15 so that a force generated by the first linear hydraulic actuator 13 is transmitted to the draw member 15. The draw member 15 is supported by the lever arm 14. Preferably the lever arm 14 has a length and it is attached to the jib 12 at a location that allow a straight draw member 15 to be connected to the lever arm 14 and to the second end 122 of the jib.

According to an embodiment, the jib assembly 1 comprises a second linear hydraulic actuator 16. The purpose of the second linear hydraulic actuator 16 is to aid the first linear hydraulic actuator 13 with the pivotal movement of the jib 12. For example, the second linear hydraulic actuator 16 comprises a hydraulic cylinder. The second linear hydraulic actuator 16 is attached to the support 11 and to the jib 12. For example, the second linear hydraulic actuator 16 comprises a first end 161 and a second end 162, and the first end 161 of the second linear hydraulic actuator 16 is attached to the support 11 and the second end 162 of the second linear hydraulic actuator 16 is attached to the jib 12.

The disclosure relates also to an excavator comprising a jib assembly 1 as described above.

The disclosure relates also to a material handler comprising a jib assembly 1 as described above.

The disclosure relates also to use of the jib assembly 1 as described above in an excavator.

The disclosure relates also to use of the jib assembly 1 as described above in a material handler.

The invention claimed is:

1. A jib assembly comprising:

a support;

a jib including a first end and a second end, wherein the first end of the jib is pivotally attached to the support for pivotal movement of the jib in relation to the support about a horizontal axis; and a first linear hydraulic actuator attached to the support for regulating pivotal movement of the jib and for maintaining the jib in a specific position relative to the support;

a lever arm attached to the jib; and a draw member unrotatably attached to the lever arm and to the second end of the jib at the second end of the jib, wherein the draw member is attached between the lever arm and the second end of the jib at the second end of the jib; wherein:

the first linear hydraulic actuator is connected to the draw member so that a force generated by the first linear hydraulic actuator is transmitted to the draw member;

the first linear hydraulic actuator and the draw member are supported by the lever arm; and the lever arm is arranged to extend in the direction above the jib.

2. The jib assembly according to claim 1, wherein the draw member is a drawbar.

3. The jib assembly according to claim 1, wherein the draw member is a cable.

4. The jib assembly according to claim 1, further comprising:

a second linear hydraulic actuator comprising a first end and a second end, the first end of the second linear hydraulic actuator being attached to the support and the second end of the second linear hydraulic actuator being attached to the jib.

5. An excavator comprising the jib assembly according to claim 1.

6. A material handler comprising the jib assembly according to claim 1.

7. The jib assembly according to claim 1, wherein the draw member extends longitudinally along a length of the jib.

8. The jib assembly according to claim 1, wherein the first end of the jib is disposed adjacent the support.

9. The jib assembly according to claim 1, wherein the first end of the jib is pivotally attached to the support at the support.

* * * * *